US011383536B2

(12) United States Patent
Genta et al.

(10) Patent No.: US 11,383,536 B2
(45) Date of Patent: Jul. 12, 2022

(54) INKJET PRINTING APPARATUS

(71) Applicant: CANON KABUSHIKI KAISHA, Tokyo (JP)

(72) Inventors: Shin Genta, Yokohama (JP); Kazuhiko Sato, Tokyo (JP); Kazuo Suzuki, Yokohama (JP); Yoshinori Nakajima, Yokohama (JP); Masataka Kato, Yokohama (JP); Mitsutoshi Nagamura, Tokyo (JP); Satoshi Azuma, Tokyo (JP); Shingo Nishioka, Yokohama (JP); Sae Mogi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/005,359

(22) Filed: Aug. 28, 2020

(65) Prior Publication Data

US 2021/0060982 A1 Mar. 4, 2021

(30) Foreign Application Priority Data

Sep. 3, 2019 (JP) ..... JP2019-160347

(51) Int. Cl.

| | |
|---|---|
| ***B41J 2/17*** | (2006.01) |
| ***B41J 11/06*** | (2006.01) |
| ***B41J 29/17*** | (2006.01) |

(52) U.S. Cl.

CPC ..... *B41J 11/06* (2013.01); *B41J 2/1714* (2013.01); *B41J 2/1721* (2013.01); *B41J 29/17* (2013.01)

(58) Field of Classification Search

CPC . B41J 11/02; B41J 11/06; B41J 2/1721; B41J 2/1714; B41J 2002/1742

See application file for complete search history.

(56) References Cited

U.S. PATENT DOCUMENTS

| | | | |
|---|---|---|---|
| 5,311,214 | A | 5/1994 | Hirasawa et al. |
| 5,739,828 | A | 4/1998 | Moriyama et al. |
| 5,887,991 | A | 3/1999 | Narita et al. |
| 5,895,155 | A | 4/1999 | Narita et al. |
| 6,089,697 | A | 7/2000 | Tajika et al. |
| 6,099,116 | A | 8/2000 | Fujita et al. |
| 6,120,141 | A | 9/2000 | Tajika et al. |
| 6,158,834 | A | 12/2000 | Kato et al. |
| 6,196,655 | B1 | 3/2001 | Hirasawa et al. |
| 6,206,502 | B1 | 3/2001 | Kato et al. |
| 6,234,606 | B1 | 5/2001 | Suzuki |
| 6,264,320 | B1 | 7/2001 | Moriyama et al. |
| 6,309,051 | B1 | 10/2001 | Koitabashi et al. |
| 6,325,492 | B1 | 12/2001 | Koitabashi et al. |
| 6,390,583 | B1 | 5/2002 | Kato et al. |
| 6,412,934 | B1 | 7/2002 | Moriyama et al. |

(Continued)

FOREIGN PATENT DOCUMENTS

JP 2017-061076 A 3/2017

*Primary Examiner* — Scott A Richmond

(74) *Attorney, Agent, or Firm* — Venable LLP

(57) ABSTRACT

Provided is an inkjet printing apparatus that can reduce smears on a back surface of a print result medium by reducing accumulation of ink in a platen while reducing generation of mist. To achieve this, an ink receiving portion of a platen is provided away from a support surface by a predetermined distance, is formed in a mesh shape by laying multiple linear members, and is formed as a guide member that guides the ink received in the ink receiving portion to an ink guide holes.

13 Claims, 14 Drawing Sheets

(56) References Cited

U.S. PATENT DOCUMENTS 6,435,639 B1 8/2002 Nakajima et al.
6,450,606 B1 9/2002 Kato et al.
6,464,328 B1 * 10/2002 Hiramatsu ..... B82Y 15/00 347/34
6,467,866 B1 10/2002 Nagoshi et al.
6,474,768 B1 11/2002 Yano et al.
6,494,557 B1 12/2002 Kato et al.
6,505,909 B1 1/2003 Kato et al.
6,572,216 B1 6/2003 Koitabashi et al.
6,585,353 B1 7/2003 Kanematsu et al.
6,612,678 B2 9/2003 Kato et al.
6,650,350 B2 11/2003 Suzuki et al.
6,652,053 B2 11/2003 Imanaka et al.
6,834,947 B2 12/2004 Moriyama et al.
6,859,220 B2 2/2005 Suzuki et al.
6,860,578 B2 3/2005 Yamada et al.
6,877,835 B2 4/2005 Kato et al.
6,918,656 B2 7/2005 Koitabashi et al.
6,966,629 B2 11/2005 Nakajima et al.
6,986,824 B2 1/2006 Suzuki et al.
6,988,783 B2 1/2006 Ikeda et al.
6,991,327 B2 1/2006 Goto et al.
7,044,592 B2 5/2006 Sato et al.
7,097,267 B2 8/2006 Kato et al.
7,119,914 B2 10/2006 Nakajima et al.
7,125,095 B2 10/2006 Yamada et al.
7,144,093 B2 12/2006 Nakajima et al.
7,281,780 B2 10/2007 Nagamura et al.
7,347,519 B2 3/2008 Nagamura et al.
7,367,643 B2 5/2008 Furuichi et al.
7,396,098 B2 7/2008 Kanematsu et al.
7,425,056 B1 9/2008 Koitabashi et al.
7,460,271 B2 12/2008 Kanematsu et al.
7,517,044 B2 4/2009 Suzuki et al.
7,556,343 B2 7/2009 Kato et al.
7,762,640 B2 7/2010 Kanda et al.
7,775,622 B2 8/2010 Suzuki et al.
7,789,476 B2 9/2010 Tomida et al.
7,891,754 B2 2/2011 Nagamura et al.
7,980,652 B2 7/2011 Baba et al.
8,057,009 B2 11/2011 Tomida et al.
8,388,090 B2 3/2013 Nakajima et al.
8,444,246 B2 5/2013 Muro et al.
8,469,484 B2 6/2013 Jogo et al.
8,517,490 B2 8/2013 Kanematsu et al.
8,608,277 B2 12/2013 Tomida et al.
8,613,492 B2 12/2013 Suzuki et al.
8,622,501 B2 1/2014 Komamiya et al.
8,628,163 B2 1/2014 Kanematsu et al.
8,630,017 B2 1/2014 Kanematsu et al.
8,636,334 B2 1/2014 Nishioka et al.
8,675,250 B2 3/2014 Muro et al.
8,702,192 B2 4/2014 Danzuka et al.
8,721,021 B2 5/2014 Nakajima et al.
8,727,477 B2 5/2014 Kosaka et al.
8,757,754 B2 6/2014 Azuma et al.
8,845,060 B2 9/2014 Azuma et al.
8,950,843 B2 2/2015 Oikawa et al.
9,028,029 B2 5/2015 Azuma et al.
9,028,049 B2 5/2015 Azuma et al.
9,039,112 B2 5/2015 Murayama et al.
9,039,120 B2 5/2015 Nishioka
9,079,421 B2 7/2015 Kato et al.
9,108,409 B2 8/2015 Suzuki et al.
9,114,607 B2 8/2015 Ishii et al.
9,211,748 B2 12/2015 Baba et al.
9,340,009 B2 5/2016 Murayama et al.
9,434,196 B2 9/2016 Fukasawa et al.
9,878,549 B1 * 1/2018 Fima ..... B41J 2/16552
10,232,644 B2 3/2019 Wada et al.
10,668,717 B2 6/2020 Azuma et al.
2009/0021548 A1 1/2009 Suzuki et al.
2009/0079777 A1 3/2009 Nagamura et al.
2012/0033006 A1 2/2012 Murayama et al.
2012/0050360 A1 3/2012 Nagamura
2012/0069067 A1 3/2012 Torigoe et al.
2013/0235107 A1 9/2013 Ibe et al.
2016/0263498 A1 * 9/2016 Kamp ..... B01D 29/52
2016/0347092 A1 * 12/2016 Kurata ..... B41J 11/0065
2017/0087884 A1 3/2017 Wada et al.
2017/0297344 A1 10/2017 Ibe et al.
2018/0353888 A1 * 12/2018 Nie ..... B04C 3/06
2020/0290359 A1 * 9/2020 Ishizaki ..... B41J 2/16511
2020/0307283 A1 10/2020 Nishioka et al.

* cited by examiner

INKJET PRINTING APPARATUS

BACKGROUND OF THE INVENTION

Field of the Invention

The present invention relates to an inkjet printing apparatus that performs printing by ejecting ink to a print medium supported on a platen.

Description of the Related Art

Japanese Patent Laid-Open No. 2017-061076 discloses an inkjet printing apparatus that performs so-called "borderless printing" in which printing is performed without margins provided in end portions of a print medium. A platen included in the inkjet printing apparatus of Japanese Patent Laid-Open No. 2017-061076 has a tilted surface that receives ink drops ejected to outside of the print medium in the borderless printing. The ink drops are made to land on the tilted surface close to the print medium to reduce a landing distance that is a distance over which the ink flies and reduce generation of mist. Reducing the generation of ink mist as described above reduces adhering of the mist to a back surface of the print medium. Moreover, the inkjet printing apparatus is configured such that the ink drops landing on the tilted surface slide down the tilted surface and then flow to an ink guide hole.

However, in some cases, the landing ink does not reach the ink guide hole and remains on the tilted surface on which the ink has landed, depending on the characteristics of the ink and the temperature and humidity of the environment. Such remaining ink gradually accumulates and, in the case where the height of the accumulating ink reaches the height of a print medium support portion of the platen, there is a risk that the accumulating ink and the back surface of the print medium come into contact with each other and the back surface of the print medium is smeared.

SUMMARY OF THE INVENTION

The present invention thus provides an inkjet printing apparatus that can reduce generation of smears on a back surface of a print medium by reducing generation of mist and accumulation of ink in a platen.

The inkjet printing apparatus of the present invention for achieving this object includes a platen having a support surface that supports a print medium to be printed by a printing unit configured to perform printing by ejecting ink, the platen includes an ink receiving portion that is provided away from the support surface by a predetermined distance in an ejection direction of the ink by the printing unit and that receives the ink ejected from the printing unit, and the ink receiving portion has a lattice shape provided with a plurality of receiving members that receive the ejected ink and a plurality of through-holes that are formed adjacent to the receiving members.

The present invention can provide an inkjet printing apparatus that can reduce smears on a back surface of a print medium by reducing accumulation of ink in a platen while reducing generation of mist.

Further features of the present invention will become apparent from the following description of exemplary embodiments with reference to the attached drawings.

DESCRIPTION OF THE EMBODIMENTS

First Embodiment

A first embodiment of the present invention is described below with reference to the drawings.

Figure 1:
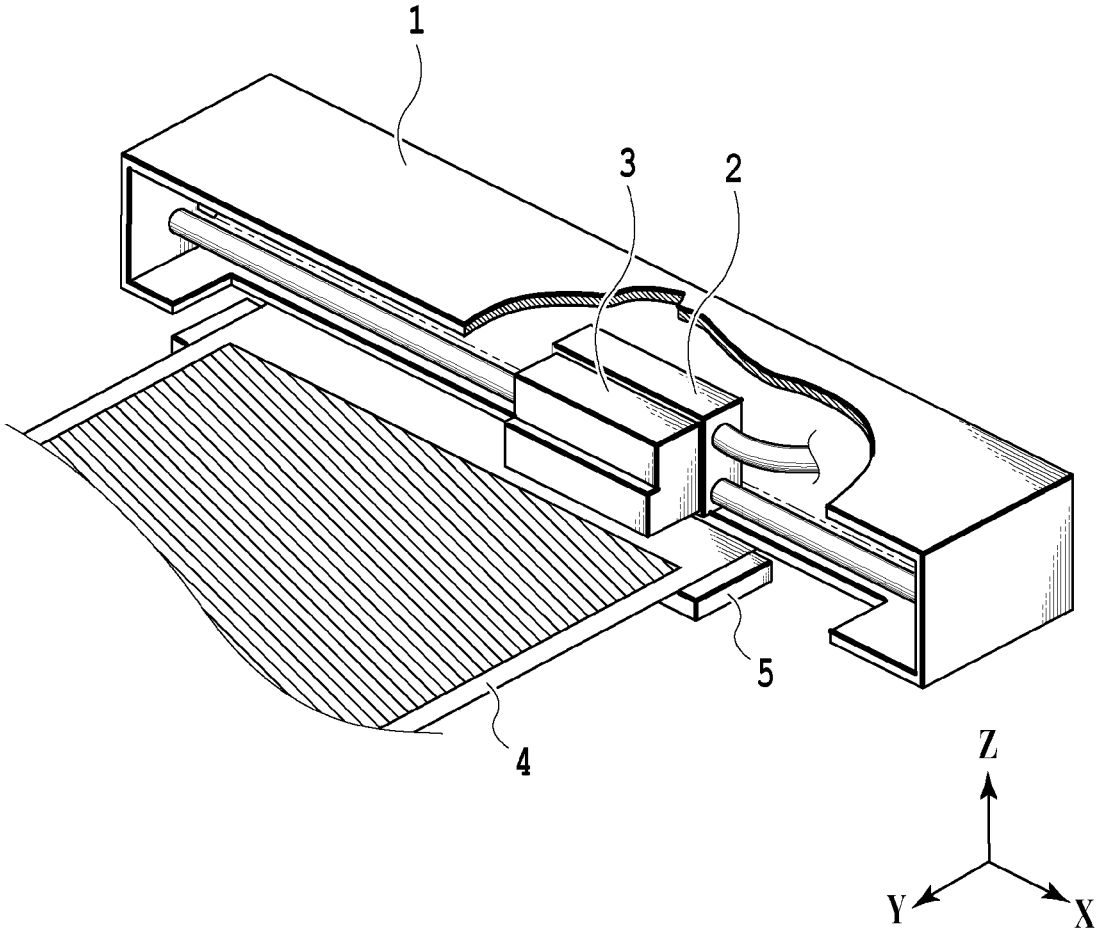
FIG. 1 is a schematic perspective view illustrating an inkjet printing apparatus.

FIG. 1 is a schematic perspective view illustrating an inkjet printing apparatus (hereafter, also simply referred to as printing apparatus) 1 in the embodiment. The printing apparatus 1 includes a carriage 2 that is provided to be capable of reciprocating in a scanning direction (X direction) intersecting a conveyance direction (Y direction) of a print medium 4 and a print head 3 that is mounted in the carriage 2 and that is capable of ejecting ink drops. The print head 3 performs printing by ejecting the ink drops to the print medium 4 while reciprocating together with the carriage 2 in the scanning direction (X direction). The printing apparatus 1 also includes a platen 5 that supports a back surface of the print medium 4 in the printing.

Figure 2:
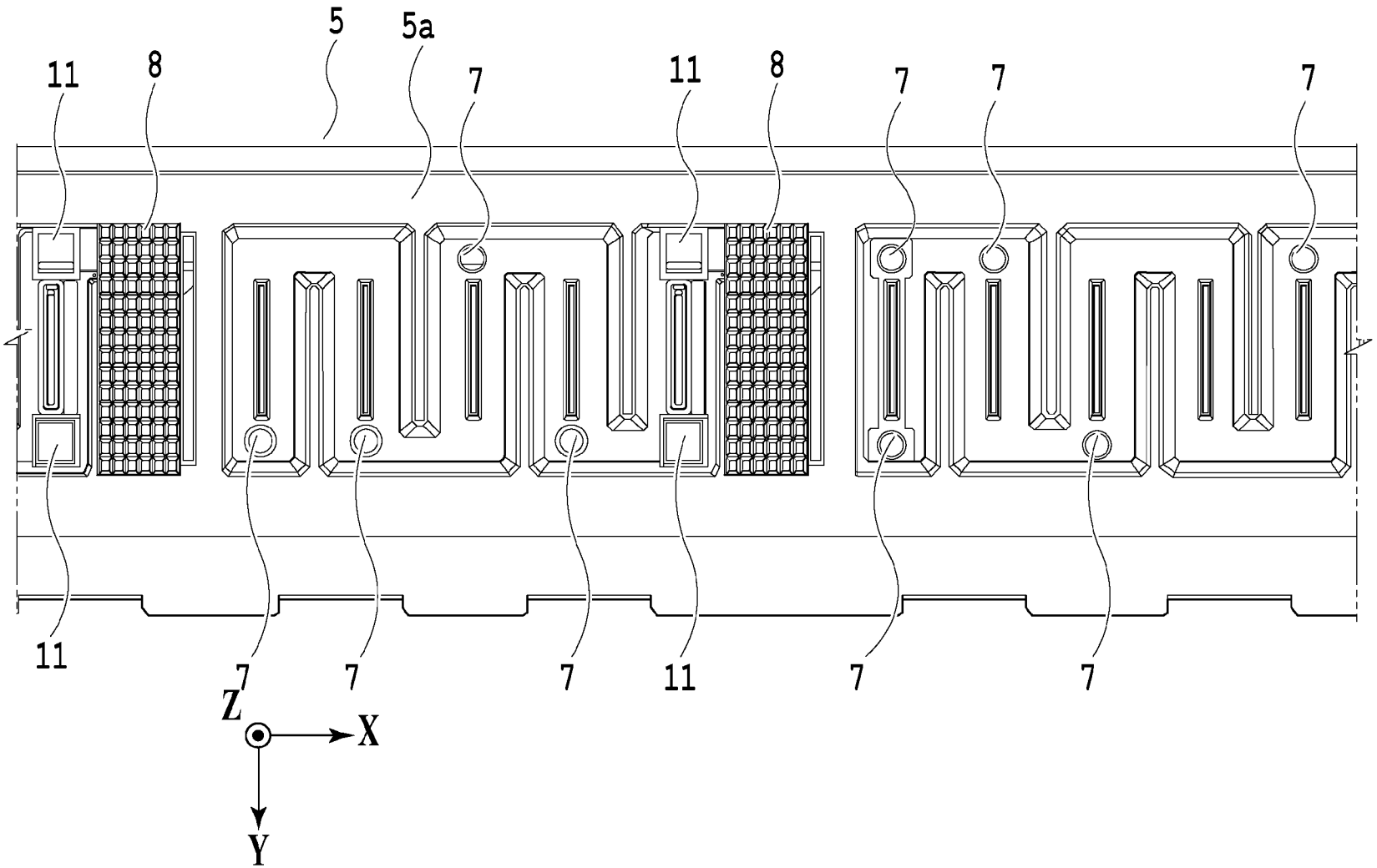
FIG. 2 is a plan view illustrating a platen.
Figure 3:
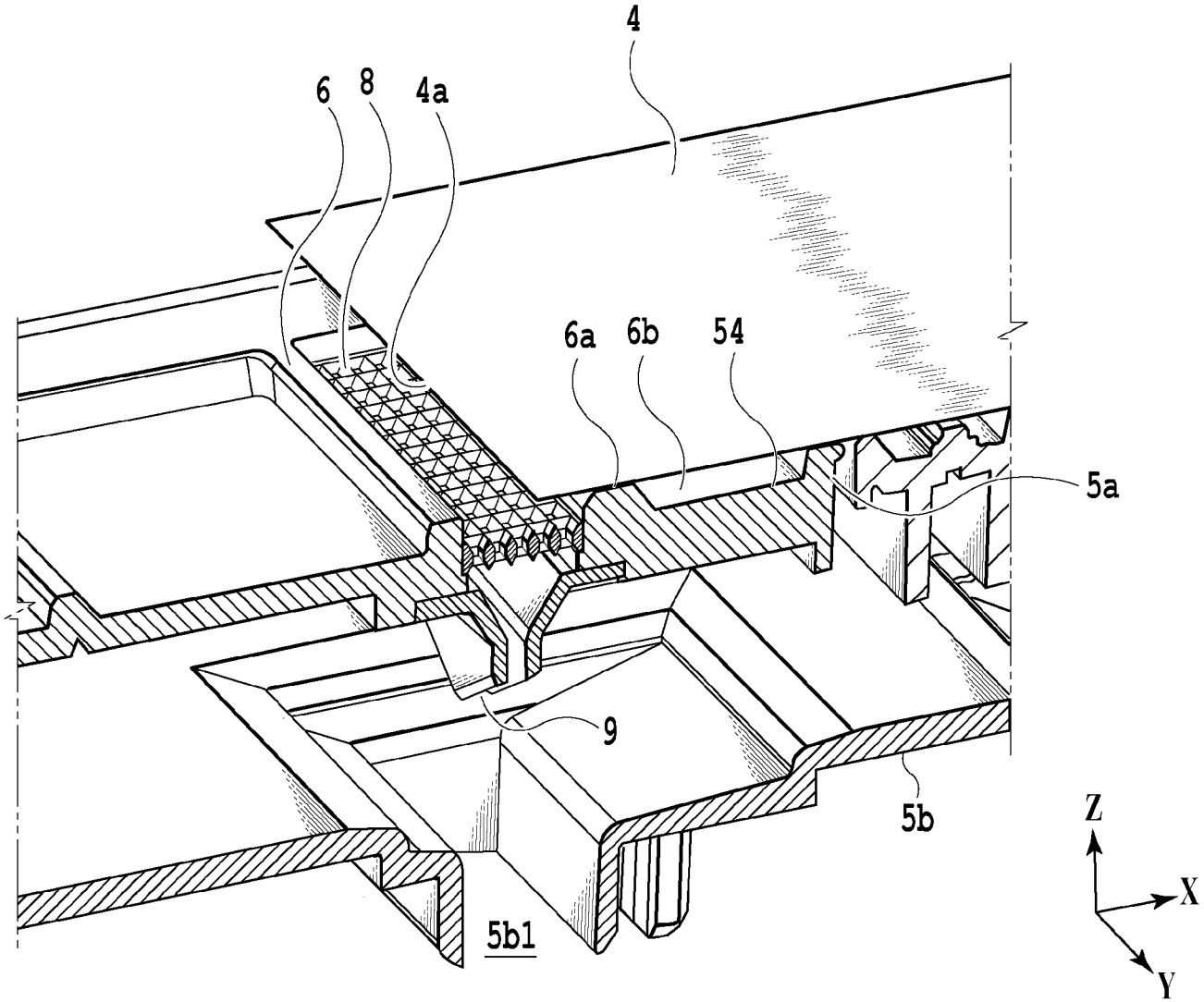
FIG. 3 is a cross-sectional perspective view of the platen.

FIG. 2 is a plan view illustrating the platen 5 and FIG. 3 is a cross-sectional perspective view of the platen 5. The platen 5 extends in the scanning direction (X direction) intersecting the conveyance direction (Y direction) of the print medium 4 and has a hollow structure formed of a flat surface member 5*a* and a base member 5*b* provided on the back side of the flat surface member 5*a*. Moreover, the platen 5 is connected to a not-illustrated suction unit and holds the print medium 4 by means of suction in the printing.

Multiple independent support portions 6 (see FIG. 3) that support the print medium 4 are arranged in flat surface portions of the platen 5 that support the print medium 4, to be aligned in the X direction. Arranging the multiple support portions 6 as described above allows the platen 5 to support various print media 4 varying in the length in the scanning direction (width) with the support portions 6 present at the positions corresponding to the widths of the print media 4. The multiple support portions 6 each include a support surface 6*a* that supports a lower surface of the print medium 4 and a recess portion 6*b* that is surrounded by the support surface 6*a* and that does not support the print medium 4. The support surfaces 6*a* have uniform height and can thereby support the print medium 4 in a flat position in the printing.

In borderless printing in which an image is printed on the entire surface of the print medium 4 with no margins provided in end portions of the print medium 4, the ink is ejected to spread out to a position outside the print medium 4. The platen 5 thus includes ink receiving portions 8 that receive ink drops ejected to spread outside the print medium 4. Moreover, the ink receiving portions 8 are provided at multiple positions in the platen 5 and are each formed in a mesh shape by laying multiple linear receiving members that receive the ink.

Multiple mesh apertures of the receiving members formed in the mesh-shape are through-holes through which the ink that does not land on the receiving members passes. The through-holes are provided adjacent to the receiving members. Specifically, each ink receiving portion 8 is formed of the receiving members and the through-holes. In order to enable borderless printing on various print media 4 varying in width, the ink receiving portions 8 are provided at multiple positions, in the scanning direction (X direction), corresponding to the positions of side end portions 4*a* of the various print media 4 conveyed by a not-illustrated conveying unit.

The ink drops ejected to the outside of the print medium 4 include ink drops that land on the receiving members of the ink receiving portion 8 as well as ink drops that do not land on the receiving members and pass through the through-holes. Ink drops having a predetermined size (volume) among the ink drops landing on the receiving members and the ink drops passing through the through-holes as described above are described as main drops. The ink drops ejected to the outside of the print medium 4 include ink drops that do not have a predetermined size unlike the main drops and turn into ink mist floating in the air in a mist form. In the platen 5, an ink guide hole 9 is provided below each ink receiving portion 8 to collect the main drops and the ink mist of the ink drops ejected to the ink receiving portion 8. The main drops and the ink mist of the ink drops ejected to the ink receiving portion 8 are guided from the ink receiving portion 8 to the ink guide hole 9.

Figure 4B:
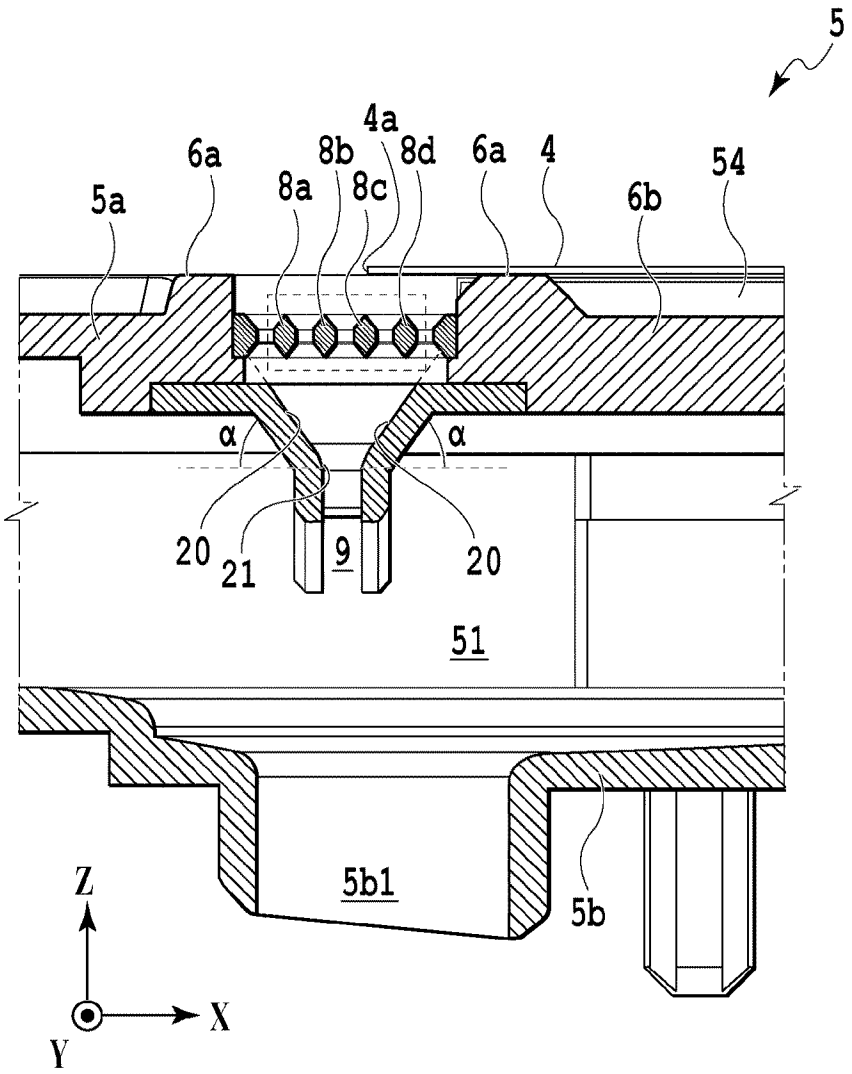
FIG. 4B is a view illustrating part of the platen in an enlarged manner.
Figure 4A:
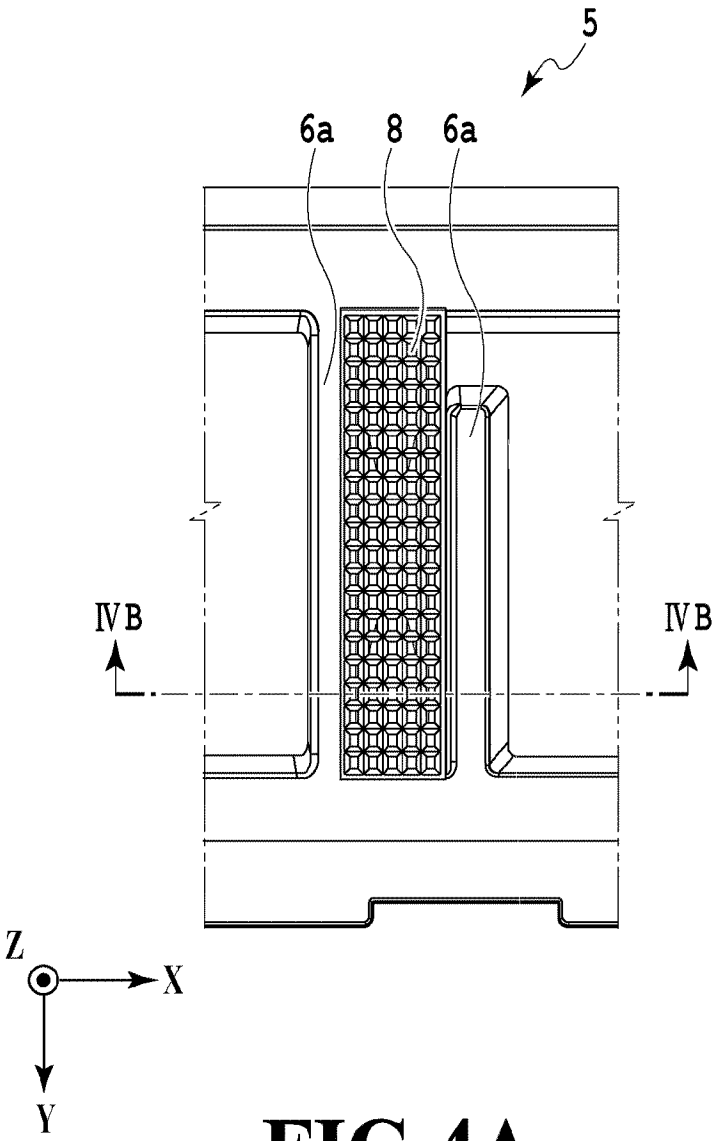
FIG. 4A is a view illustrating part of the platen in an enlarged manner.

FIGS. 4A and 4B are views illustrating part of the platen 5 in an enlarged manner. As described above, the platen 5 includes the flat surface member 5*a* and the base member 5*b* and is formed to have the hollow structure having a space between the flat surface member 5*a* and the base member 5*b*. Moreover, an opening portion 5*b*1 is formed at a position facing each ink guide hole 9 in the base member 5*b*. Each ink receiving portion 8 is provided between the support surface 6*a* and the support surface 6*a* in the X direction and is located below the side end portion 4*a* of the print medium 4 to be away from the side end portion 4*a* of the print medium 4 at a predetermined interval in the height direction (Z direction). In the borderless printing, the ink drops ejected to the outside of the side end portion 4*a* of the print medium 4 partially land on the receiving members of the ink receiving portion 8 and partially passes through the through-holes. The ink drops passing through the through-holes of the ink receiving portion 8 pass through the ink guide hole 9 and are collected into an ink collection portion (not illustrated) in a lower space through the opening portion 5*b*1.

The mesh-shaped ink receiving portion 8 that receives the ink drops ejected to the outside of the print medium 4 is a plate-shaped porous body which is substantially parallel to the support surfaces 6*a* and in which many holes (mesh apertures) are formed. Moreover, an area of the hole of the through-holes of the ink receiving portion 8 is desirably greater than the cross-sectional area of the receiving members in the horizontal direction. Making the hole diameter greater than the cross-sectional area of the receiving members forming the ink receiving portion in the horizontal direction reduces the proportion of the ink drops landing on the receiving members of the ink receiving portion 8 and increases the proportion of the ink drops passing through the through-holes to be guided to the ink guide hole 9 in the ink drops ejected to the outside of the side end portion 4*a* of the print medium 4. Accumulation of the ink on the receiving members of the ink receiving portion 8 can thereby reduced.

As illustrated in FIG. 4B, the receiving members (8*a*, 8*b*, 8*c*, 8*d*) of the ink receiving portion 8 have a polygonal cross-sectional shape in the direction of gravity (Z direction). Moreover, the receiving members are configured to receive the ejected ink on tilted surfaces of the receiving members. The received ink is more likely to be guided to the ink guide hole 9 through the through-holes by receiving the ejected ink on the tilted surfaces as described above. Moreover, the ink guide hole 9 is formed at a position substantially directly below the side end portion 4*a* of the print medium 4 in the Z direction and the ink drops and ink mist ejected to the outside of the side end portion 4*a* and passing through the ink receiving portion 8 or falling from the ink receiving portion 8 to the lower space can be efficiently guided downward. The ink and ink mist guided to the ink guide hole 9 pass through the opening portion 5*b*1 formed at a position substantially directly below the ink guide hole 9 in the Z direction and is collected into the ink collection portion (not illustrated) provided in the lower space.

Moreover, an ink flow portion 20 for guiding the ink to the ink guide hole 9 is formed in the −Z direction of the ink receiving portion 8. The ink flow portion 20 includes tilted surfaces that guide the ink to an opening 21 of the ink guide hole 9 and the ink and ink mist that do not directly reach the opening 21 of the ink guide hole 9 adhere to the tilted surfaces. As illustrated in FIG. 4B, the ink flow portion 20 has a shape narrowing toward the lower side and formed of the tilted surfaces and a lower portion of the ink flow portion 20 is connected to the ink guide hole 9. The ink and ink mist adhering to the ink flow portion 20 run down the tilted surfaces of the ink flow portion 20 to be guided to the ink guide hole 9. The ink flow portion 20 is desirably designed such that the tilted surfaces illustrated in FIG. 4B have a large tilt angle $\alpha$ with respect to the horizontal plane to facilitate guiding of the ink to the ink guide hole 9. The tilt angle $\alpha$ of the tilted surfaces of the ink flow portion 20 is preferably within a range of 50 to 90 degrees.

Figure 5:
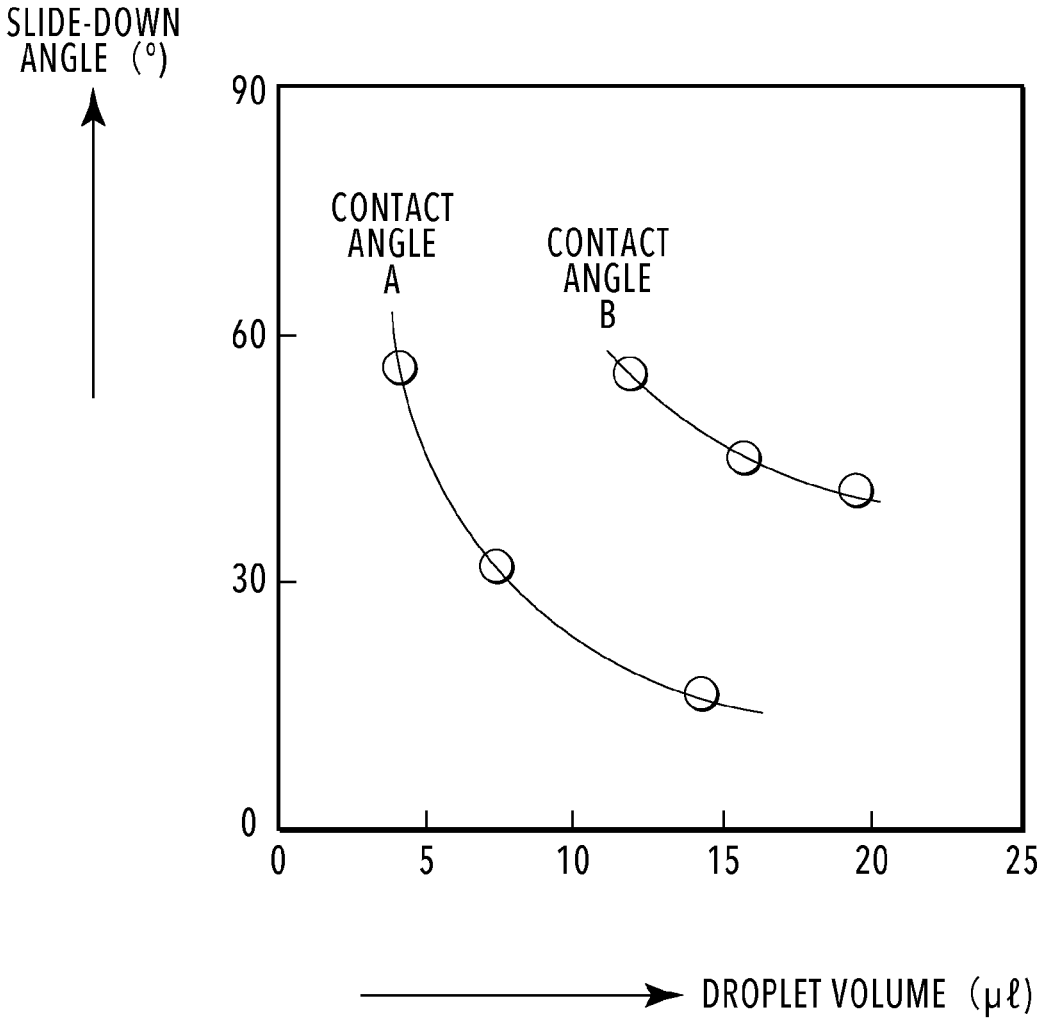
FIG. 5 is a graph illustrating relationships between a droplet volume and an angle at which a droplet starts to slide down.

FIG. 5 is a graph illustrating relationships between the droplet volume of the ejected ink drop and the angle at which the droplet starts to slide down in the case where the ink drop adheres to the tilted surface, for two types of contact angles. Note that the contact angles satisfy the relationship of contact angle A<contact angle B. Generally, sliding down of a droplet on a tilted surface depends on the size of the droplet, and $\gamma$ (unit N/m) that is adhesion energy of the droplet is proportional to a circumference length $2\pi r$ of the droplet. Meanwhile, falling energy $\lambda$ of the droplet is mg sin $\alpha$, where m is the mass of ink, g is the gravitational acceleration, and $\alpha$ is the tilt angle, and the mass m is volume×specific weight and the volume of a sphere is $4/3\pi r^3$. Accordingly, the falling energy $\lambda$ for which the contribution rate of radius is high becomes greater than the adhesion energy $\gamma$ at a predetermined droplet size.

The ink ejected from the print head 3 is a fine droplet of about 4 pl. Due to the reasons described above, in the case where the size of the droplet adhering to the tilted surface is sufficiently large, the falling energy is greater than the adhesion energy and the droplet falls. However, the smaller the size of the droplet is, the smaller the difference between the adhesion energy and the falling energy is and the droplet is less likely to slide down unless the tilt angle $\alpha$ at which the droplet slides down is set sufficiently large. Accordingly, in the embodiment, the configuration is such that the tilt angle $\alpha$ of the ink flow portion 20 with respect to the horizontal plane is set to about 60 degrees. Note that, in order to cause the droplet to slide down, the tilted surface to which the droplet adheres is desirably close to vertical as a matter of course and the tilt angle is not limited to 60 degrees as long as the configuration of the main body allows.

Figure 6A:
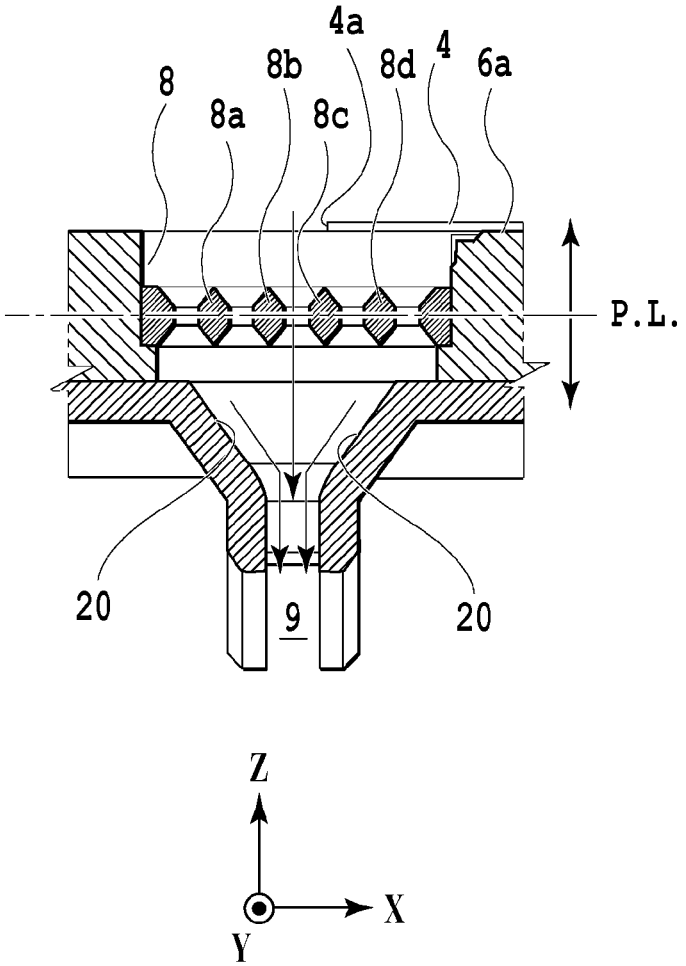
FIG. 6A is a view illustrating an ink receiving portion.
Figure 6B:
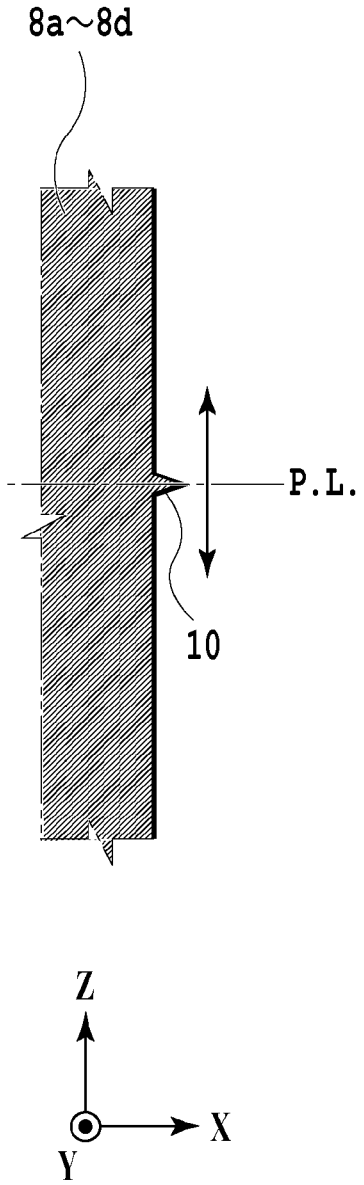
FIG. 6B is a view illustrating the ink receiving portion.
Figures 7A, 7B, 7C:
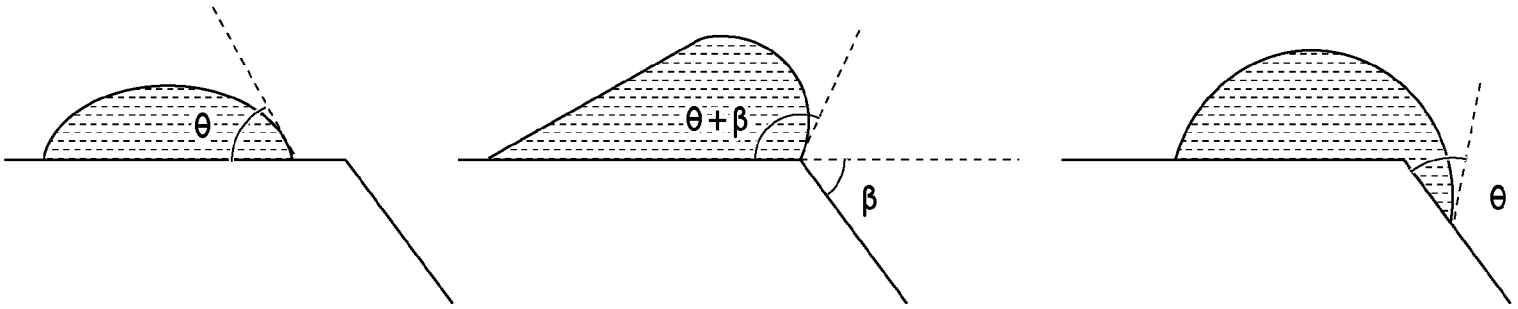
FIG. 7A is a view illustrating a model relating to wettability of a droplet.
FIG. 7B is a view illustrating the model relating to the wettability of the droplet.
FIG. 7C is a view illustrating the model relating to the wettability of the droplet.

FIGS. 6A and 6B are views illustrating the ink receiving portion 8 and FIGS. 7A to 7C are views illustrating a model relating to wettability of the droplet. As illustrated in FIG. 6A, both end portions of each receiving member (8*a*, 8*b*, 8*c*, 8*d*) of the ink receiving portion 8 in the Z direction are formed to have acute angles to guide the landed ink quickly to the ink guide hole 9. Moreover, connection surfaces that are intermediate portions between both end portions of each receiving member (8*a* to 8*d*) in the Z direction are formed of vertical flat walls (surfaces). In the case where a droplet with a contact angle $\theta$ as illustrated in FIG. 7A comes to an angle change portion with a tilt angle $\beta$ as illustrated in FIG. 7B in a joining portion between a surface and another surface, the droplet cannot move forward until the contact angle of the droplet reaches $\theta+\beta$. In the case where the contact angle of the droplet reaches $\theta+\beta$, the droplet can pass the angle change portion as illustrated in FIG. 7C. Based on this principle, each receiving member (8*a* to 8*d*) includes the tilted surfaces with the tilt angle $\beta$ in regions where the ink run down set as small as possible, and the cross-sectional shape of the receiving member in the direction of gravity (Z direction) is configured to be polygonal.

Moreover, in the case where the ink receiving portion 8 is molded as a resin member by injection molding, as illustrated in FIG. 6A, a mold seam (P.L.: parting line) is provided at an intermediate point of each receiving member (8*a*, 8*b*, 8*c*, 8*d*) in the Z direction. In some cases, a protrusion shaped burr 10 is formed at the parting line (see FIG. 6B). As described above, the flow of ink in the angle change portion has such a restriction that the flow is affected by the contact angle of the ink. Moreover, presence of the burr 10 in a route along which the ink runs may hinder the passing of the ink. If the burr 10 is formed in the angle change portion in the route, the restriction due to the contact angle and the physical restriction due to the burr 10 are assumed to be great obstacles for the passing of the ink. Accordingly, it is desirable that the burr 10 and the angle change portion on the surface on which the ink runs are not formed at the same position and the parting line is formed in a portion other than the angle change portion.

In the embodiment, the cross-sectional shape of each receiving member in the direction of gravity (Z direction) is substantially hexagonal and the parting line is provided on the vertical wall surfaces as illustrated in FIG. 6B. Since the ink drops run down the vertical walls where they are most affected by the gravity, the hindering of ink flow is prevented as much as possible and the ink can be guided to the ink guide hole 9 even if the burr 10 is formed.

Figure 8A:
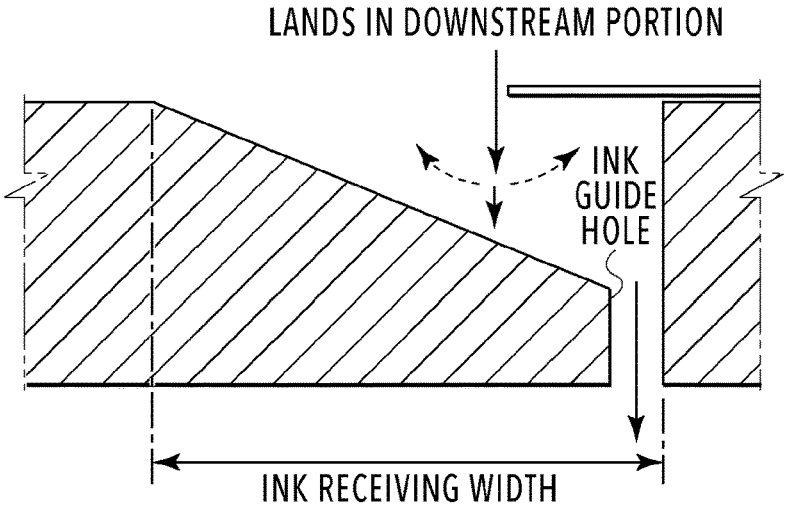
FIG. 8A is a view for comparing conventional ink receiving portions and the ink receiving portion of the embodiment.
Figure 8B:
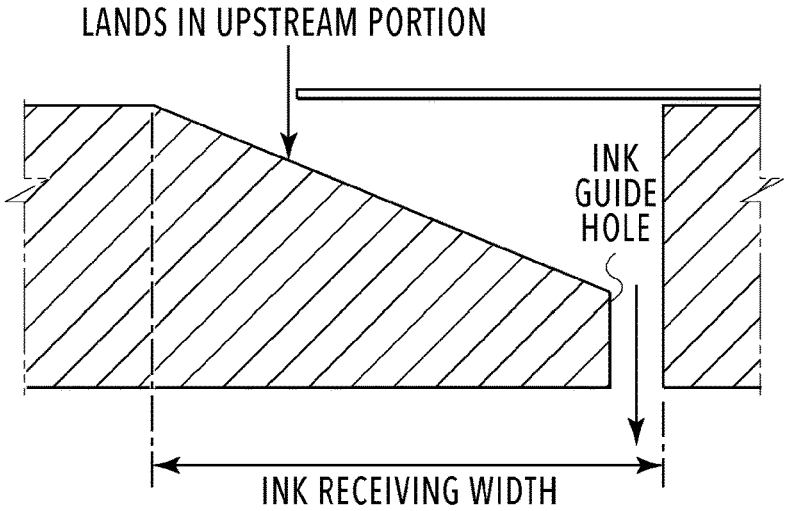
FIG. 8B is a view for comparing the conventional ink receiving portions and the ink receiving portion of the embodiment.
Figure 8C:
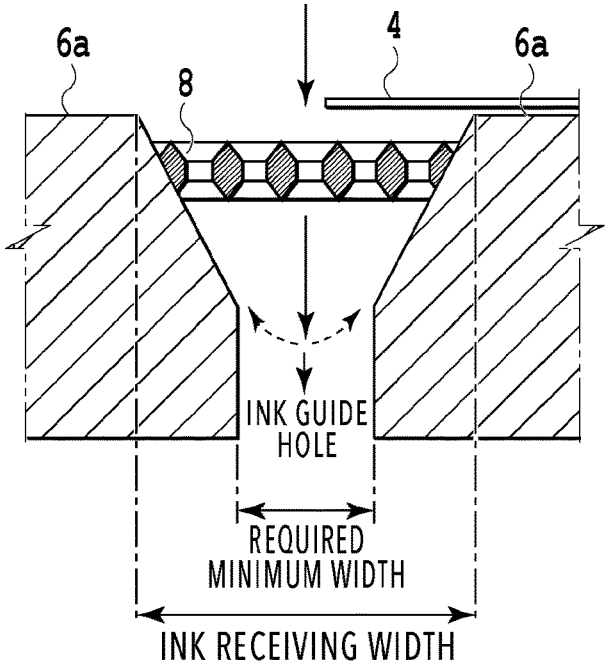
FIG. 8C is a view for comparing the conventional ink receiving portions and the ink receiving portion of the embodiment.

FIGS. 8A to 8C are views for comparing conventional ink receiving portions and the ink receiving portion 8 of the embodiment. FIGS. 8A and 8B illustrate the conventional ink receiving portions and FIG. 8C illustrates the ink receiving portion 8 of the embodiment.

Each of the conventional ink receiving portions includes a tilted surface tilted at a certain angle with respect to a print medium support portion to guide the ink landing on the ink receiving portion to an ink guide hole and is connected to the ink guide hole at the lowest position of the tilted surface. In the case where borderless printing is performed in such an ink receiving portion, the ink ejected to the outside of the print medium temporarily lands on the tilted surface of the ink receiving portion. In this case, if the ink is to be landed at a position close to the ink guide hole in the tilted surface as illustrated in FIG. 8A, a landing distance from the ejection to the landing of the ink is long and the ink turns into ink mist and scatters before the landing of the ink drop due to air resistance. Then, the scattered ink mist may adhere to a print result medium or float and adhere to inner and outer portions of the apparatus.

Accordingly, in the conventional ink receiving portion illustrated in FIG. 8B, the ink is made to land at a position away from the ink guide hole in the tilted surface. The landing distance is thereby made as short as possible and the generation of ink mist is reduced.

However, in the case where the ink is made to land at a position away from the ink guide hole in the tilted surface as in FIG. 8B, the distance between the tilted surface and the print medium is short. Accordingly, if the ink landing on the tilted surface stays in place without moving toward the ink guide hole and accumulates, the accumulating ink is more likely to come into contact with the print medium. As described above, in the configuration of the conventional ink receiving portions, it is sometimes difficult to reduce the generation of ink mist while avoiding contact of the accumulating ink and the back surface of the print medium.

In the ink receiving portion 8 in the embodiment, the ink guide hole 9 is provided directly below the end portion of the print medium and the mesh-shaped ink receiving portion 8 is provided at the position away from the back surface of the printing medium at the predetermined interval. The predetermined interval in this case is set to such a distance that no ink mist is generated from the ejected ink drop. The receiving members of the ink receiving portion 8 thereby receive the ejected ink and reduce the generation of mist. For the ink passing through the through-holes of the ink receiving portion 8, the generation of floating mist is reduced by directly guiding the ink turning into mist in air to the ink guide hole 9 or by causing it to adhere to the wall surface of the ink guide hole 9.

Moreover, the cross-sectional shape of the receiving members of the ink receiving portion 8 in the direction of gravity (Z direction) is configured to be polygonal and the ink drops landing on the ink receiving portion 8 are guided to the ink guide hole 9 by using the tilted surfaces of the polygonal shape. Thus, the accumulation of the ink on the ink receiving portion 8 can be reduced.

As described above, the ink receiving portion 8 of the embodiment has a guide structure that guides the ink landing on the receiving members of the ink receiving portion 8 to the ink guide hole 9 with the tilted surfaces while reducing the generation of the ink mist, and can thereby reduce the accumulation of the ink on the receiving members of the ink receiving portion 8.

Note that, in the case where the printing apparatus uses a print head with a large length in the conveyance direction (Y direction) of the print medium, the length of the platen in the conveyance direction of the print medium increases according to the length of the print head and the area of the ink receiving portion increases with this increase in length. In the case where the area of the ink receiving portion 8 increases, the volume of the space which needs to be set to negative pressure to suck the print medium increases. Thus, the negative pressure force per unit area decreases and the suction efficiency decreases. Accordingly, the suction force acting on the print medium decreases and the print medium is more likely to lift in the printing. Hence, in a printer employing a long print head, the area of the ink receiving portion is desirably made as small as possible.

As described above, the ink receiving portion 8 of the platen 5 is provided away from the print medium supported on the support surface, by a predetermined distance. Moreover, the receiving members of the ink receiving portion 8 are formed in the mesh shape and include the tilted surfaces that guide the ink received by the ink receiving portion 8 to the ink guide hole 9. This can reduce the accumulation of the ink in the platen 5 while suppressing the generation of mist and thereby achieve an inkjet printing apparatus that can reduce smears on the back surface of a print result medium.

Second Embodiment

A second embodiment of the present invention is described below with reference to the drawings. Since the basic configuration of this embodiment is the same as that of the first embodiment, only the characteristic configurations are described below.

Conventionally, a method in which dye ink is used on microporous media have been mainly used to print images such as silver halide photographs from viewpoints of glossiness and the like. However, there is also provided an inkjet printing apparatus that achieves high glossiness while using pigment ink in addition to dye ink from a viewpoint of image fastness.

In the case where a dot diameter of the pigment ink landing on the print medium is compared with that of the dye ink, the dot diameter of the pigment ink is smaller than the dot diameter of the dye ink and is about 0.75 to 0.8 times the dot diameter of the dye ink. This means that, in the case where the pigment ink and the dye ink land on the same print medium surface, the dye ink tends to wet and spread on the print medium and the pigment ink is less likely to wet and spread. The wettability and spreadability of the ink on the print medium surface depend on the contact angle of the ink with the print medium surface. The dye ink has a smaller contact angle with the print medium surface than the pigment ink and tends to wet and spread more than the pigment ink. Meanwhile, the pigment ink has a larger contact angle with the print medium surface than the dye ink and tends to wet and spread less than the dye ink.

Accordingly in the embodiment, in an inkjet printing apparatus that ejects the dye ink, the surfaces of the ink receiving portion 8 and the ink flow portion 20 are modified to hydrophilic surfaces that are highly-wettable surfaces.

Figure 9:
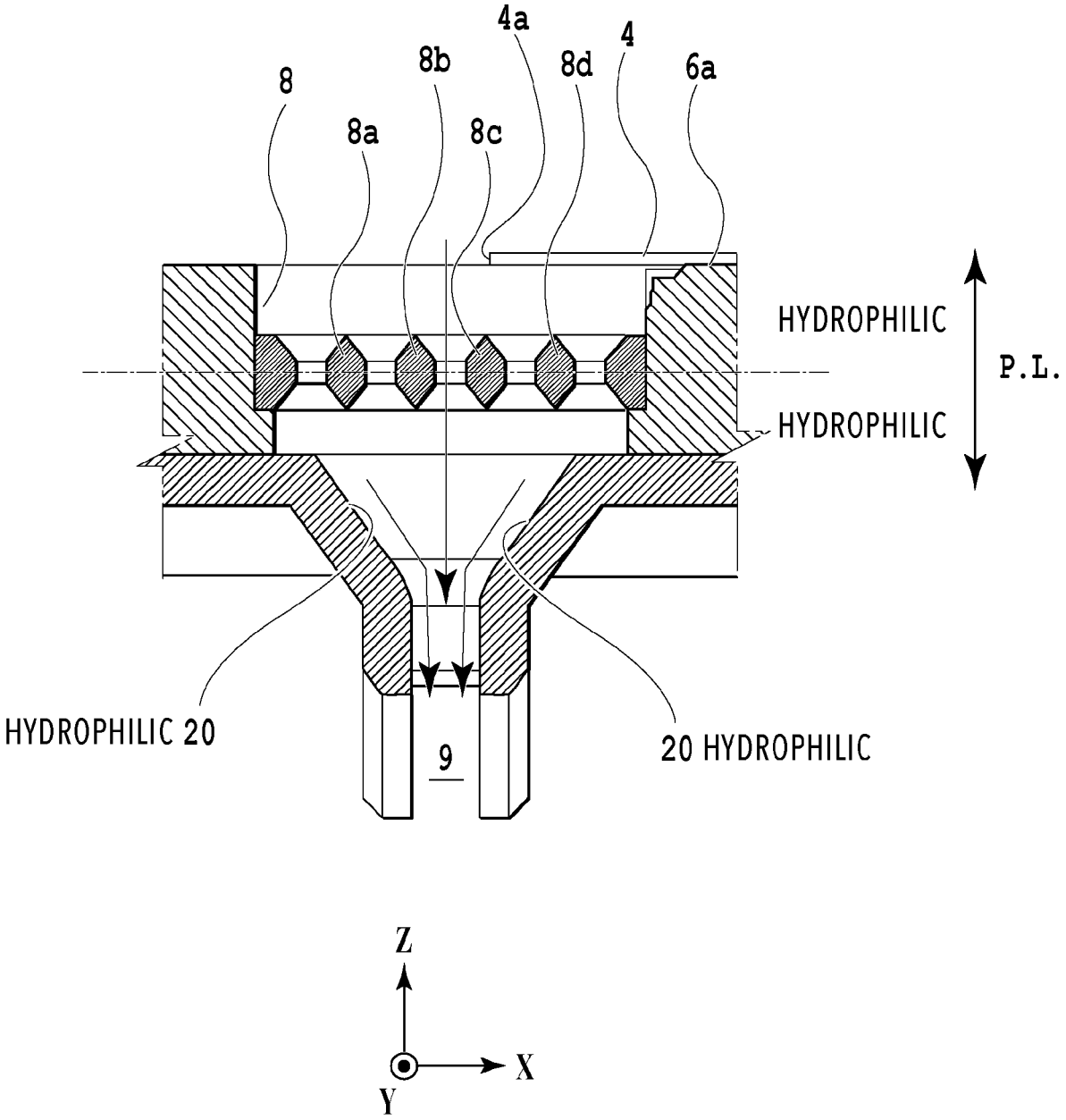
FIG. 9 is a cross-sectional view illustrating the ink receiving portion and an ink flow portion.

FIG. 9 is a cross-sectional view illustrating the ink receiving portion 8 and the ink flow portion 20 in the embodiment. The surfaces of the ink receiving portion 8 and the ink flow portion 20 of the embodiment are modified to hydrophilic surfaces. Modifying the surfaces of the ink receiving portion 8 and the ink flow portion 20 to hydrophilic surfaces as described above further increases the wettability and spreadability of the dye ink that originally has a tendency to wet and spread, on the surfaces of the ink receiving portion 8 and the ink flow portion 20. Increasing the wettability and spreadability of the ink drop reduces the contact angle of the ink drop with the surfaces of the ink receiving portion 8 and the ink flow portion 20 and the accumulation height of the ink can be thus suppressed to a low level even if the ink accumulates. Accordingly, smears on the back surface of the print result medium can be reduced. Moreover, with the increase in the spreadability of droplets on the surfaces, the ink drop can be efficiently guided to the ink guide hole 9.

Although there are various methods of modifying the surfaces, in the embodiment, the modification is achieved by changing surface roughness of the molds used in the injection molding. Generally, there is such a principle that the closer a solid surface is to a smooth surface without unevenness, the higher the hydrophilic property is. Accordingly, the surfaces of the injection molding molds for the ink receiving portion 8 and the ink flow portion 20 are subjected to polishing or the like to be formed into smooth surfaces and the surfaces of the ink receiving portion 8 and the ink flow portion 20 are thereby made to function as the hydrophilic surfaces. Moreover, a configuration in which a functional liquid for hydrophilic processing is applied or a configuration in which a hydrophilic sheet member is attached may be employed as other means.

As described above, in addition to the first embodiment, the surfaces of the receiving members of the ink receiving portion 8 are formed as hydrophilic surfaces. This can reduce the accumulation of the ink in the platen while reducing the generation of mist and thereby achieve an inkjet printing apparatus that can reduce smears on a back surface of a print result medium.

Third Embodiment

A third embodiment of the present invention is described below with reference to the drawings. Since the basic configuration of this embodiment is the same as that of the first embodiment, only the characteristic configurations are described below.

In the embodiment, in an inkjet printing apparatus that ejects the pigment ink, the surfaces of the ink receiving portion 8 and the ink flow portion 20 are modified to water-repellent surfaces that are surfaces with low wettability.

Figure 10:
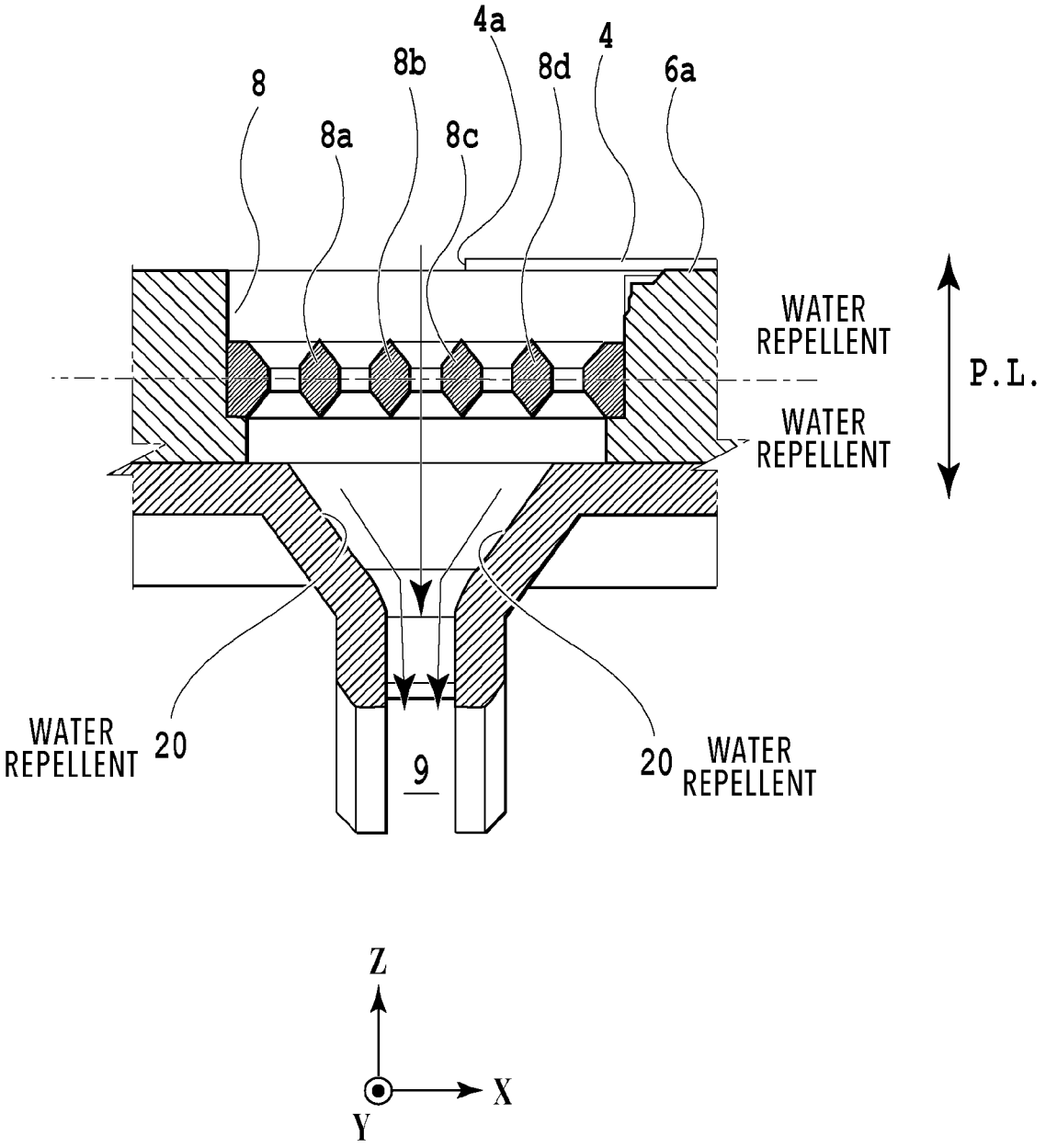
FIG. 10 is a cross-sectional view illustrating the ink receiving portion and the ink flow portion.

FIG. 10 is a cross-sectional view illustrating the ink receiving portion 8 and the ink flow portion 20 in the embodiment. The surfaces of the ink receiving portion 8 and the ink flow portion 20 of the embodiment are modified to water repellent surfaces. Modifying the surfaces of the ink receiving portion 8 and the ink flow portion 20 to water repellent surfaces that are surfaces with low wettability as described above further reduces the wettability and spreadability of the pigment ink that originally has a low tendency to wet and spread, on the surfaces of the ink receiving portion 8 and the ink flow portion 20.

Reducing the wettability and spreadability of the ink drop as described above increases the contact angle of the ink drop with the surfaces of the ink receiving portion 8 and the ink flow portion 20 and the ink drop is more likely to be repelled on the surfaces. The ink drop is thereby made less likely to stay in place. Making the ink drop less likely to stay in place as described above enables efficient guiding of the ink drop from the ink receiving portion 8 to the ink guide hole 9 and the ink accumulation on the surfaces can be reduced.

Although there are various methods of modifying the surface of the ink receiving portion 8, in the embodiment, the modification is achieved by changing surface roughness of the molds used in the injection molding. Generally, there is such a principle that the greater the surface area of a solid surface is, that is the greater the unevenness on the surface is, the higher the water repellent property is. Accordingly, a surface of the injection molding mold for the ink receiving portion 8 is roughened by etching or the like to form an uneven shape on the surface and the surface of the ink receiving portion 8 is made to function as the water repellent surface. Moreover, a configuration in which a functional liquid for water repellent processing is applied or a configuration in which a water repellent sheet member is attached may be employed as other means.

As described above, in addition to the first embodiment, the surfaces of the receiving members of the ink receiving portion 8 are formed as water repellent surfaces. This can reduce the accumulation of the ink in the platen while reducing the generation of mist and thereby achieve an inkjet printing apparatus that can reduce smears on a back surface of a print result medium.

Fourth Embodiment

A fourth embodiment of the present invention is described below with reference to the drawings. Since the basic configuration of this embodiment is the same as that of the first embodiment, only the characteristic configurations are described below.

Figure 11A:
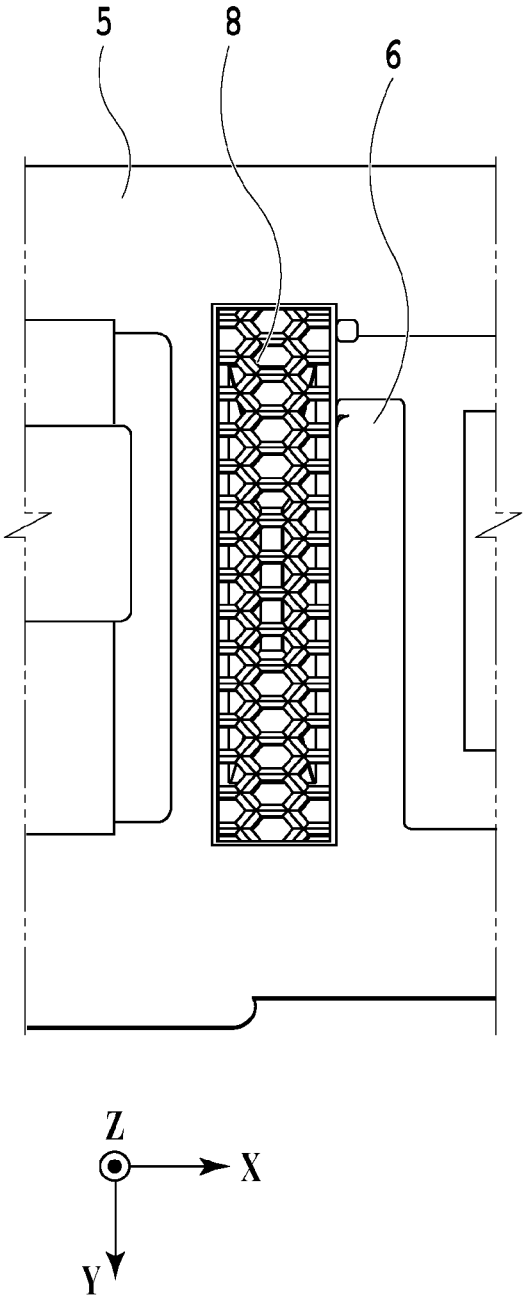
FIG. 11A is an enlarged view illustrating the ink receiving portion of the platen.
Figure 11B:
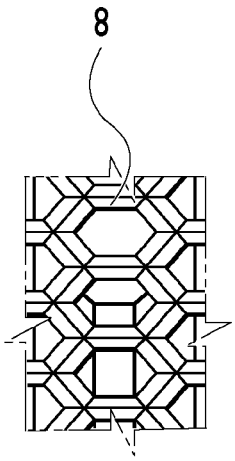
FIG. 11B is an enlarged view illustrating the ink receiving portion of the platen.

FIGS. 11A and 11B are enlarged top views illustrating the ink receiving portion 8 of the platen 5 in the embodiment. The ink receiving portion 8 of the embodiment is configured such that the shape of the through-holes is a regular hexagon or a substantially hexagonal shape.

In the lattice-shaped mesh illustrated in the first embodiment, in the case where the ink ejected onto the ink receiving portion 8 remains in the mesh aperture, an ink film is sometimes formed in the through-hole due to interfacial tension acting between the lattice and the remaining ink. In the case where the ink film is formed, there is a risk that the ink film increases in viscosity over time and solidifies to block the through-hole and the solidified ink gradually accumulates. Accordingly, it is ideal to suppress the formation of ink film in the through-hole as much as possible.

We examine a lattice shape that can reduce formation of the ink film as much as possible. Assume that force acting on the ink film formed between portions of the lattice (in the through-hole) includes:

interfacial tension (force acting between the ink and the lattice)=force for forming the ink film; and surface tension (surface tension of the ink)+gravity=force for breaking the ink film.

In this case, the greater the surface tension is relative to the interfacial tension, the greater the effect of suppressing the formation of ink film is exhibited.

The interfacial tension is proportional to a circumferential length [m] of one lattice cell. Moreover, the surface tension is surface free energy per unit area and is expressed in units of [$J/m^2$=N/m]. Accordingly, it is found that, in order to increase the surface tension relative to the interfacial tension, it is effective to reduce the circumferential length [m] per unit area of the through-holes in the ink receiving portion 8.

Employing a circular shape is effective in reducing the circumferential length per unit area. However, in the case of forming a lattice, a circular shape cannot cover a plane without gaps and polygonal shapes are thus considered. Generally, polygonal shapes that can cover a plane include three shapes of regular triangle, square, and regular hexagon and the regular hexagon has the smallest circumferential length, provided that these three shapes have the same area. In other words, designing the lattice shape to be regular hexagon can increase the surface tension relative to the interfacial tension.

Accordingly, in the embodiment, the lattice shape in the ink receiving portion 8 is configured to be a honeycomb (hexagonal) shape to increase the surface tension relative to the interfacial tension. This can suppress formation of the ink film in each through-hole and suppress accumulation of the ejected ink.

As described above, in addition to the first embodiment, in the ink receiving portion 8, the multiple receiving members are laid in the lattice shape that is regular hexagon. This can reduce the accumulation of the ink in the platen while reducing the generation of mist and thereby achieve an inkjet printing apparatus that can reduce smears on the back surface of a print result medium.

Fifth Embodiment

A fifth embodiment of the present invention is described below with reference to the drawings. Since the basic configuration of this embodiment is the same as that of the first embodiment, only the characteristic configurations are described below.

Figure 12A:
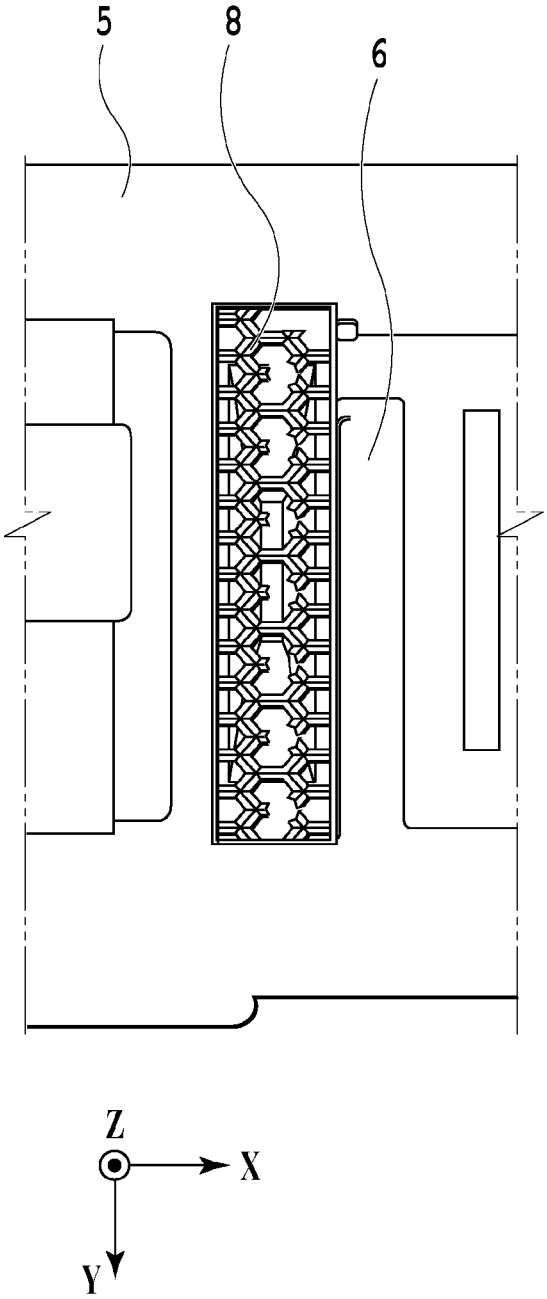
FIG. 12A is an enlarged view illustrating the ink receiving portion of the platen.
Figure 12B:
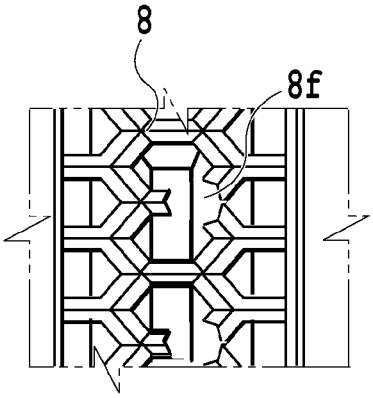
FIG. 12B is an enlarged view illustrating the ink receiving portion of the platen.

FIGS. 12A and 12B are enlarged views illustrating the ink receiving portion 8 of the platen 5 in the embodiment. The ink receiving portion 8 of the embodiment has a configuration in which a honeycomb lattice is partially absent. The ink film formed in the lattice has a very stable physical structure in the case where each through-hole has a closed shape. As one means of disrupting the stability of the ink film, an outer periphery of the through-hole may be partially cut away to reduce the force for stabilizing the film.

As illustrated in FIGS. 12A and 12B, at least one cut-away portion 8*f* is provided in the outer periphery of each through-hole of the ink receiving portion 8. This cut-away portion 8*f* functions to reduce the force for forming the ink film.

Although the structure in which the outer peripheries of the through-holes with the honeycomb shape are partially absent is described in the embodiment, the cut-away portions may be provided in outer peripheries of through-holes with other polygonal shapes such as, for example, triangle and quadrangle.

Moreover, the outer periphery of the through-hole only needs to be partially absent and the portion that is absent is not limited to a particular portion.

As described above, in addition to the fourth embodiment, in the ink receiving portion 8, the multiple receiving members are laid to have a configuration shape formed of partially-absent hexagons. This can suppress formation of the ink film in the through-holes.

Sixth Embodiment

A sixth embodiment of the present invention is described below with reference to the drawings. Since the basic configuration of this embodiment is the same as that of the first embodiment, only the characteristic configurations are described below.

Figure 13C:
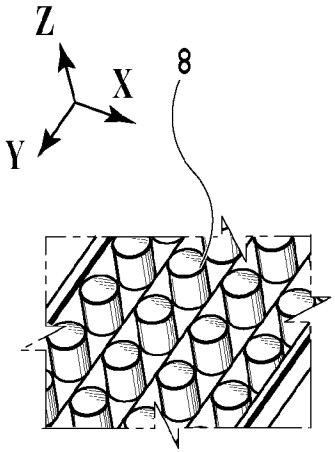
FIG. 13C is an enlarged view illustrating the ink receiving portion of the platen.
Figure 13B:
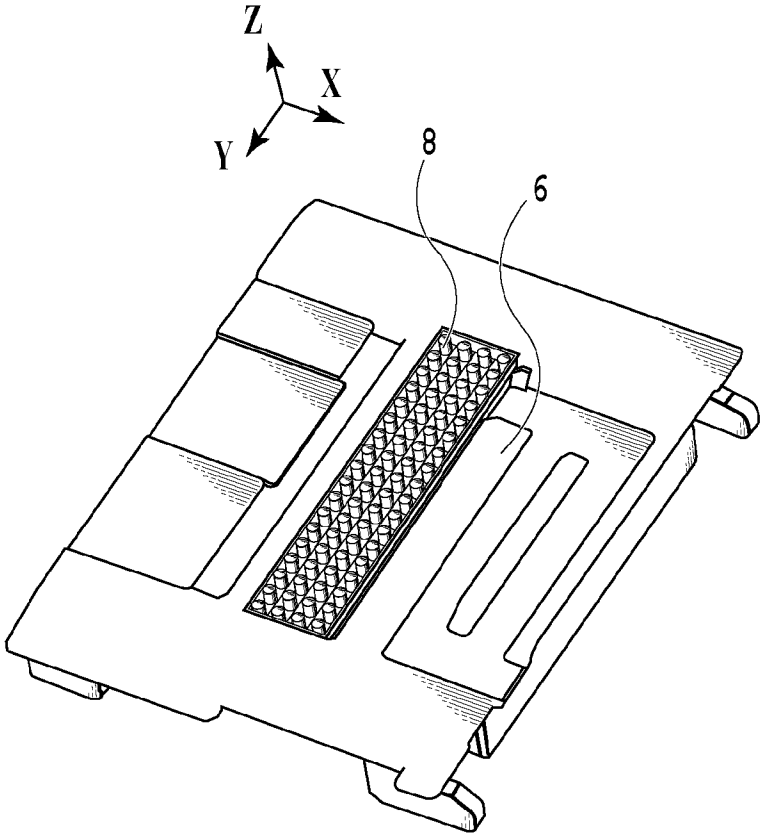
FIG. 13B is an enlarged view illustrating the ink receiving portion of the platen.
Figure 13A:
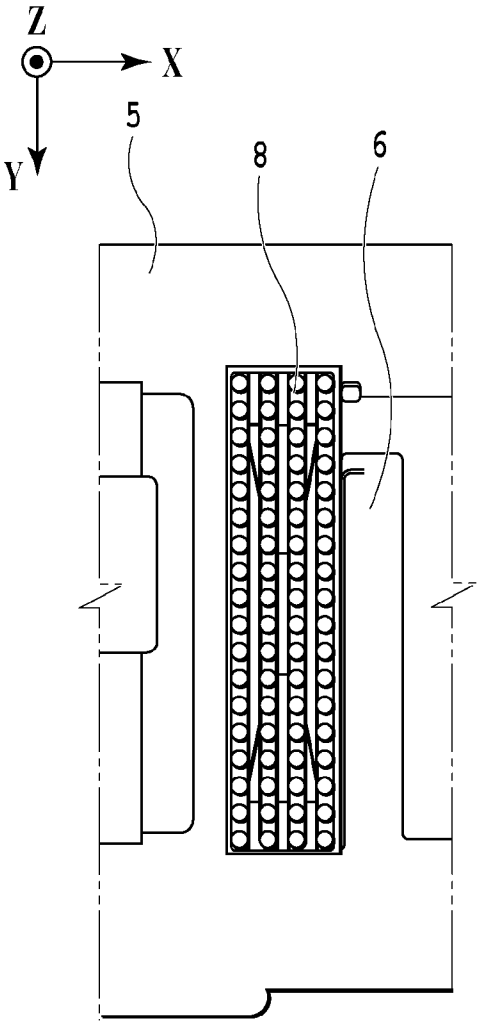
FIG. 13A is an enlarged view illustrating the ink receiving portion of the platen.

FIGS. 13A to 13C are enlarged views illustrating the ink receiving portion 8 of the platen 5 in the embodiment. The ink receiving portion 8 of the embodiment has a configuration in which multiple pillars (pillar bodies) are arranged on laid receiving members, the configuration being one means for disrupting the stability of the ink film and being a guide structure that guides the ink to the ink guide hole 9. A portion between each two adjacent receiving members is a through-hole penetrating the ink receiving portion 8. In the configuration in which the multiple pillars (pillar bodies) are arranged on the receiving members, in the case where the ink is ejected between the pillars, the interfacial tension does not work stably between the pillars. In other words, the ink film is unstable between the pillars and the formation of the ink film can be thus suppressed. Accordingly, the ink received between the pillars does not stay between the pillars and is guided to the ink guide hole 9 through the through-hole.

Although the configuration in which cylindrical pillars are arranged is described as an example in the embodiment, configurations in which pillars with polygonal prism shapes such as, for example, triangular prism and quadrangular prism are arranged may be used.

As described above, the receiving members of the ink receiving portion 8 have the configuration in which multiple pillars (pillar bodies) are arranged and this can suppress the formation of ink film.

Seventh Embodiment

A seventh embodiment of the present invention is described below with reference to the drawings. Since the basic configuration of this embodiment is the same as that of the first embodiment, only the characteristic configurations are described below.

Figure 14A:
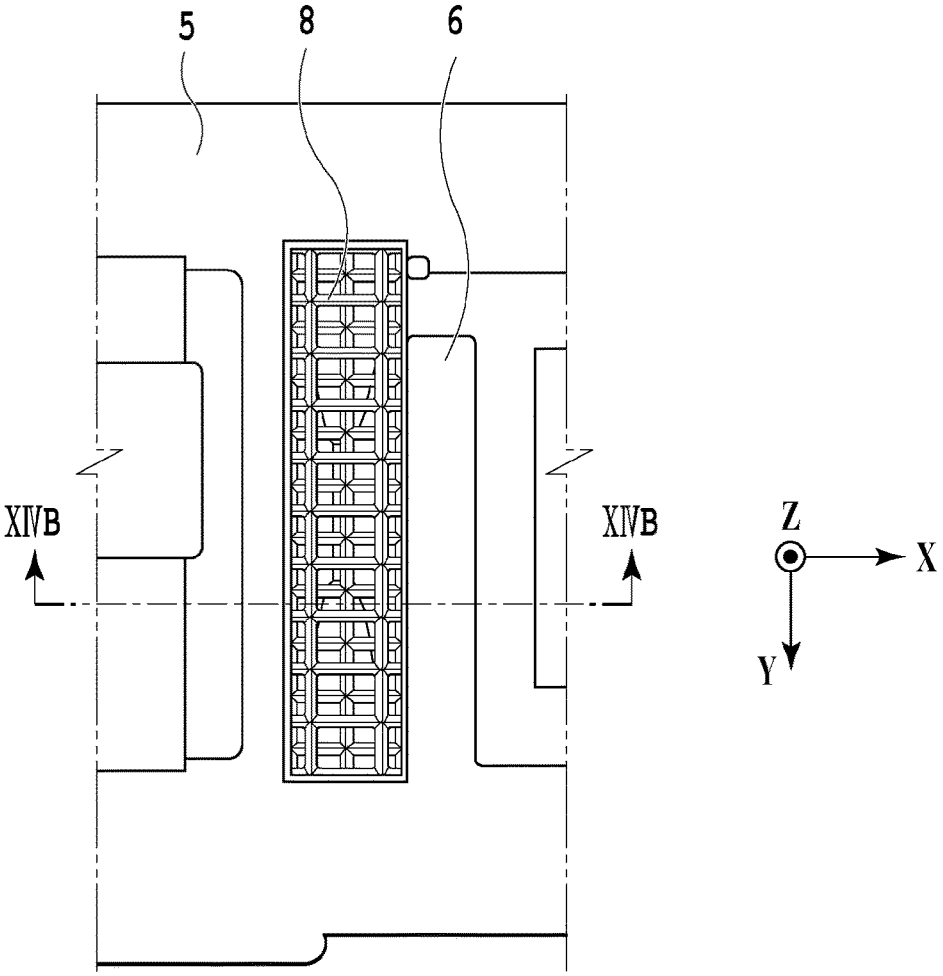
FIG. 14A is an enlarged view illustrating the ink receiving portion of the platen.
Figure 14B:
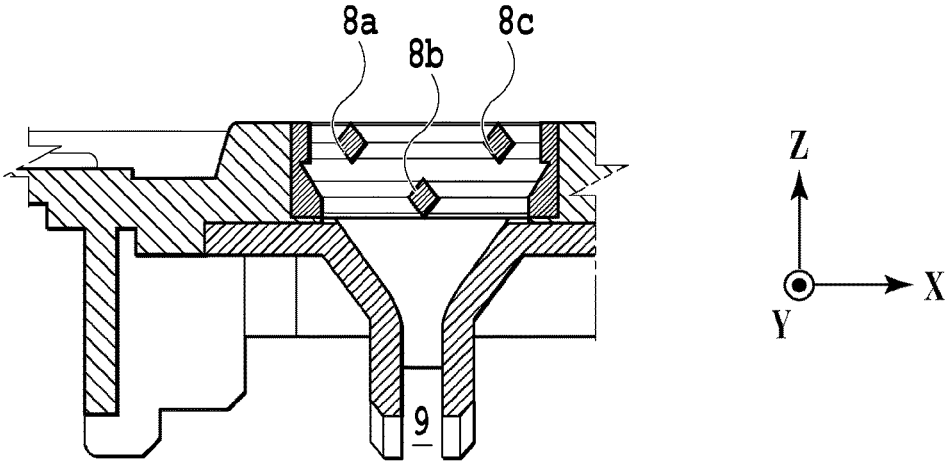
FIG. 14B is an enlarged view illustrating the ink receiving portion of the platen.

FIGS. 14A and 14B are enlarged views illustrating the ink receiving portion 8 of the platen 5 in the embodiment. The ink receiving portion 8 of the embodiment has a configuration that disrupts the stability of the ink film, and the laid receiving members are provided at different height levels in the Z direction to three-dimensionally intersect one another. A receiving member 8*b* whose position in the Z direction is different from those of receiving members 8*a* and 8*c* of the ink receiving portion 8 is provided between the receiving members 8*a* and 8*c*. Providing the adjacent receiving members at different height levels as described above has such an effect that, in the case where the ink film is formed between the receiving members 8*a* and 8*c* at the higher positions, the ink film is more likely to break by capillary force of the receiving member 8*b* between the receiving members 8*a* and 8*c*. Accordingly, the formation of ink film can be suppressed.

Moreover, providing the receiving member 8*b* arranged at a position facing the ink guide hole 9 below the receiving members 8*a* and 8*c* in the periphery of the receiving member 8*b* can provide such an effect that the ink runs down the receiving member 8*b* and flows downward.

As described above, the receiving members of the ink receiving portion 8 are formed by being laid three-dimensionally to intersect one another in the direction of gravity. This can reduce the accumulation of the ink in the platen while reducing the generation of mist and thereby achieve an inkjet printing apparatus that can reduce smears on a back surface of a print result medium.

Note that the aforementioned embodiments may be carried out in any combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-160347 filed Sep. 3, 2019, which is hereby incorporated by reference herein in its entirety.

What is claimed is:

1. An inkjet printing apparatus comprising:

a platen having a support surface that supports a print medium to be printed on by a printing unit configured to perform printing by ejecting ink, wherein the platen includes an ink receiving portion that is provided away from the support surface by a predetermined distance in an ejection direction of the ink by the printing unit and that receives the ink ejected from the printing unit, wherein the ink receiving portion has a lattice shape provided with (a) a plurality of receiving members that receive the ejected ink and (b) a plurality of through-holes that are formed adjacent to the receiving members, wherein each of the through-holes has a hexagonal shape, and wherein an outer periphery of each of the through-holes is partially absent.

2. The inkjet printing apparatus according to claim 1, wherein the ink receiving portion receives the ink ejected to outside of the print medium by the printing unit.

3. The inkjet printing apparatus according to claim 1, wherein each of the plurality of receiving members (a) is formed such that a cross-sectional shape in the ejection direction is polygonal, and (b) has a tilted surface that receives the ejected ink and that is tilted with respect to the support surface.

4. The inkjet printing apparatus according to claim 3, wherein, in each of the plurality of receiving members, an angle formed between the tilted surface and a connection surface connected to the tilted surface is an obtuse angle.

5. The inkjet printing apparatus according to claim 1, wherein surfaces of the receiving members are hydrophilic surfaces.

6. The inkjet printing apparatus according to claim 1, wherein receiving members, of the plurality of receiving members, that are adjacent to each other are provided at different positions in the ejection direction and three-dimensionally intersect each other.

7. The inkjet printing apparatus according to claim 1, wherein the ink receiving portion is provided at each of a plurality of portions of the platen in a width direction of the print medium.

8. The inkjet printing apparatus according to claim 1, wherein surfaces of the plurality of receiving members are water-repellent surfaces.

9. An inkjet printing apparatus comprising:

a platen having a support surface that supports a print medium to be printed on by a printing unit configured to perform printing by ejecting ink, wherein the platen includes an ink receiving portion that is provided away from the support surface by a predetermined distance in an ejection direction of the ink by the printing unit and that receives the ink ejected from the printing unit, wherein the ink receiving portion is provided with a plurality of through-holes, wherein each of the through-holes has a hexagonal shape, and wherein an outer periphery of each of the through-holes is partially absent.

10. The inkjet printing apparatus according to claim 9, wherein the ink receiving portion receives the ink ejected to outside of the print medium by the printing unit.

11. The inkjet printing apparatus according to claim 1, wherein the platen includes (a) an ink flow portion that receives the ink having passed the plurality of through-holes of the ink receiving portion and (b) an ink guide hole that is connected to the ink flow portion.

12. The inkjet printing apparatus according to claim 11, wherein a surface of the ink flow portion is a hydrophilic surface or a water repellent surface.

13. The inkjet printing apparatus according to claim 11, wherein the platen includes an opening portion to which the ink having passed the ink guide hole is guided.

* * * * *